US012690611B2

(12) United States Patent
Liu et al.

(10) Patent No.: US 12,690,611 B2
(45) Date of Patent: Jul. 28, 2026

(54) ULTRASONIC ATOMIZER AND ELECTRONIC CIGARETTE

(71) Applicant: CHINA TOBACCO HUNAN INDUSTRIAL CO., LTD., Changsha (CN)

(72) Inventors: Jianfu Liu, Changsha (CN); Kejun Zhong, Changsha (CN); Xiaoyi Guo, Changsha (CN); Xinqiang Yin, Changsha (CN); Jianhua Yi, Changsha (CN); Chaoxiang Huang, Changsha (CN); Yongquan Zhou, Changsha (CN)

(73) Assignee: China Tobacco Hunan Industrial Co., Ltd., Changsha (CN)

( * ) Notice: Subject to any disclaimer, the term of this patent is extended or adjusted under 35 U.S.C. 154(b) by 518 days.

(21) Appl. No.: 17/920,732

(22) PCT Filed: Apr. 22, 2021

(86) PCT No.: PCT/CN2021/088837
§ 371 (c)(1),
(2) Date: Oct. 21, 2022

(87) PCT Pub. No.: WO2021/213454
PCT Pub. Date: Oct. 28, 2021

(65) Prior Publication Data

US 2023/0165303 A1 Jun. 1, 2023

(30) Foreign Application Priority Data

Apr. 23, 2020 (CN) ..... 202010327005.0
Apr. 23, 2020 (CN) ..... 202020631448.4
Apr. 23, 2020 (CN) ..... 202020633783.8

(51) Int. Cl.
*A24F 40/05* (2020.01)
*A24F 40/10* (2020.01)
*A24F 40/42* (2020.01)

(52) U.S. Cl.
CPC ..... *A24F 40/05* (2020.01); *A24F 40/10* (2020.01); *A24F 40/42* (2020.01)

(58) Field of Classification Search
None
See application file for complete search history.

(56) References Cited

U.S. PATENT DOCUMENTS

2018/0070637 A1* 3/2018 Deng ..... A24F 40/485
2019/0373949 A1* 12/2019 Pan ..... A24F 40/44

FOREIGN PATENT DOCUMENTS

CN 205658373 U 10/2016
CN 205671480 U 11/2016
(Continued)

OTHER PUBLICATIONS

Machine translation of WO 2018024004 A1 (Year: 2025).*
(Continued)

*Primary Examiner* — Michael H. Wilson
*Assistant Examiner* — Tobey C Le
(74) *Attorney, Agent, or Firm* — MASCHOFF BRENNAN; Michael Mauriel; Elaine K. Lee

(57) ABSTRACT

An electronic vaping set, and in particular, an ultrasonic atomizer and an electronic cigarette are disclosed. An embodiment of the ultrasonic atomizer comprises an atomization cavity with an air inlet and a vapor outlet, wherein an ultrasonic atomization piece and various elements of the embodiment are arranged such that an inclined upward airflow channel from the air inlet to the vapor outlet is formed above the ultrasonic atomization piece. Embodiments of the present invention can reduce E-liquid droplets
(Continued)

in vapor, thereby preventing the E-liquid droplets from being inhaled by a user, and improving the user experience.

20 Claims, 9 Drawing Sheets

(56) References Cited

FOREIGN PATENT DOCUMENTS

| | | | | | |
|---|---|---|---|---|---|
| CN | 206443207 | U | | 8/2017 | |
| CN | 206949536 | U | | 2/2018 | |
| CN | 110934342 | A | | 3/2020 | |
| CN | 212437274 | U | | 2/2021 | |
| CN | 212437276 | U | | 2/2021 | |
| CN | 212437281 | U | | 2/2021 | |
| WO | WO-2018024004 | A1 | * | 2/2018 | ..... A24B 15/167 |
| WO | WO-2018188640 | A1 | * | 10/2018 | ..... A24B 15/167 |
| WO | WO-2018188642 | A1 | * | 10/2018 | ..... A24B 15/167 |

OTHER PUBLICATIONS

Machine translation of WO 2018188642 A1 (Year: 2025).*
Machine translation of WO 2018188640 A1 (Year: 2025).*
"Ultrasonic atomization", Wikipedia, https://en.wikipedia.org/wiki/Ultrasonic_atomization. (Year: 2025).*
International Search Report issued in International Application No. PCT/CN2021/088837 dated Jul. 8, 2021, 3 pages.

* cited by examiner

ULTRASONIC ATOMIZER AND ELECTRONIC CIGARETTE

CROSS REFERENCE TO RELATED APPLICATIONS

This application is a U.S. National Phase application under 35 U.S.C. § 371 of International Application No. PCT/CN2021/088837 filed on Apr. 22, 2021 and claims priority to Chinese Application No. 202010327005.0 filed on Apr. 23, 2020, Chinese Application No. 202020631448.4 filed on Apr. 23, 2020, and Chinese Application No. 202020633783.8 filed on Apr. 23, 2020.

FIELD OF THE INVENTION

The present invention relates to an electronic vaping set, and in particular, to an ultrasonic atomizer and an electronic cigarette.

BACKGROUND OF THE INVENTION

The top surface and bottom surface of an atomization cavity of an existing ultrasonic electronic cigarette atomizer are almost parallel, and an air inlet and a smoke outlet are arranged relatively close to each other, so that intake airflow in the atomization cavity and an atomization surface of an ultrasonic atomization piece cannot form an angle, so that e-liquid droplets splashed during atomization easily flow out of the smoke outlet along with the airflow, and the e-liquid droplets are always inhaled by a user, which affects the smoking experience.

In addition, in the existing ultrasonic electronic cigarette atomizer, an e-liquid guide ceramic is in indirect contact with an atomization region of the ultrasonic atomization piece, that is, atomization cotton is abutted against the atomization region of the ultrasonic atomization piece by the e-liquid guide ceramic, and the e-liquid guide ceramic will hinder or occupy part of the atomization region of the ultrasonic atomization piece, so that the amount of e-liquid atomized by the ultrasonic atomization piece in a time internal is reduced, and the amount of smoke generated in a time internal is reduced accordingly. Meanwhile, the energy released by the ultrasonic atomization piece during the atomization of e-liquid is quickly absorbed by the e-liquid guide ceramic, so that the temperature of e-liquid in an e-liquid cartridge rises, which affects the decomposition or instability of other mixtures in the e-liquid, shortens the shelf life of the e-liquid, and causes poor taste of smoke generated by atomization of the e-liquid.

SUMMARY OF THE INVENTION

In order to overcome the technical problem in the prior art that e-liquid is easily inhaled by a user, the present invention provides an ultrasonic atomizer and an electronic cigarette which can prevent the user from inhaling e-liquid droplets.

In order to solve the above technical problem, the present invention provides an ultrasonic atomizer, including an atomization cavity with an air inlet and a smoke outlet, an ultrasonic atomization piece is installed at the bottom of the atomization cavity, the top surface of the atomization cavity is configured as a first inclined surface, an angle of 20°-75° is formed between the first inclined surface and the ultrasonic atomization piece, the air inlet is arranged at the bottom end of the first inclined surface, the smoke outlet is arranged at the top end of the first inclined surface, the air inlet and the smoke outlet are arranged on two opposite sides of the atomization cavity respectively, and the bottom surface of the smoke outlet is higher than the top surface of the air inlet, so that an inclined upward airflow channel from the air inlet to the smoke outlet is formed above the ultrasonic atomization piece.

The inventor found that: when the ultrasonic atomizer is used, the smoke near an atomization region of the ultrasonic atomization piece is mixed with a lot of splashing e-liquid droplets; when air passes near the atomization region, these e-liquid droplets are easily brought into user's mouth, and the user inhales e-liquid, thereby affecting smoke taste; and the smoke far from the atomization region mixes and diffuses with air to form relatively thin smoke, which is easily carried away by airflow. Accordingly, it is tactfully configured in the present invention that the top surface of the atomization cavity is a first inclined surface at an angle of 20°-75° with respect to the atomization region of the ultrasonic atomization piece. The air inlet of the atomization cavity, with its opening size gradually increases, is arranged at the bottom end of the first inclined surface, the smoke outlet is arranged at the top end of the first inclined surface, the air inlet and the smoke outlet are arranged on two opposite sides of the atomization cavity respectively, and the bottom surface of the smoke outlet is higher than the top surface of the air inlet, so that an inclined upward airflow channel from the air inlet to the smoke outlet is formed above the ultrasonic atomization piece. After intake air enters the atomization cavity from the air inlet of the atomization cavity, most of the air is guided by the top surface of the atomization cavity and flows obliquely upward to the smoke outlet. In this process, because the opening size of the air inlet gradually increases, the air flow rate in the atomization cavity is smaller than the air flow rate at the air inlet, and the air flow rate near the first inclined surface is greater than that near the surface of the ultrasonic atomization piece, so that the e-liquid droplets in the smoke near the surface of the ultrasonic atomization piece can directly fall on the ultrasonic atomization piece under the action of gravity to participate in ultrasonic atomization again, the e-liquid droplets in the smoke flowing to the smoke outlet are reduced, and the e-liquid droplets are prevented from entering the user's mouth. In addition, because the airflow channel near the first inclined surface is the shortest, most of the intake air flow (air flow with relative fast flow rate) flows along the first inclined surface to the smoke outlet, that is, most of the intake air flow passes through the end of smoke and brings smoke far from the surface of the atomization region of the ultrasonic atomization piece to the smoke outlet, and the smoke is inhaled by the user, thereby improving smoke taste. A small part of the intake air (air with a slower flow rate) passes through the beginning of smoke, that is, the surface of the atomization region, and the smoke containing large-particle e-liquid droplets near the surface of the atomization region hits the inner wall of the atomization cavity near the smoke outlet and condenses, while a small part of the air returns to the ultrasonic atomization piece along the inner wall of the atomization cavity under the action of gravity for atomization again, so the e-liquid can be fully used, and the user can be prevented from inhaling the e-liquid droplets.

Preferably, an e-liquid guide ceramic is placed above the atomization region of the ultrasonic atomization piece, an air passage is provided in the middle part of the e-liquid guide ceramic, and the air passage is arranged corresponding to the center of the atomization region of the ultrasonic atomization piece. Therefore, even if the air passage is correspondingly arranged at the position where the ultrasonic atomization piece oscillates most violently, the surface of the atomization region with the most violent ultrasonic oscillation in the ultrasonic atomization piece will not be covered by the e-liquid guide ceramic, the timely discharge of smoke atomized by high-frequency oscillation at the center of the ultrasonic atomization piece will not be hindered, and the e-liquid droplets splashed during the high-frequency oscillation can also be absorbed.

In order to prevent the top surface of the air passage of the e-liquid guide ceramic from affecting the trend of inclined upward flow of air, the top surface of the air passage is configured as a second inclined surface, and the first inclined surface and the second inclined surface are located on the same inclined surface.

Preferably, the e-liquid guide ceramic is n-shaped as a whole, so that the e-liquid guide ceramic can guide e-liquid to the atomization region of the ultrasonic atomization piece, and the ultrasonic atomization efficiency is not affected although the e-liquid guide ceramic substantially shields the atomization region of the ultrasonic atomization piece. Meanwhile, only a thin layer of e-liquid reservoir on the surface of the atomization region of the ultrasonic atomization piece stores a small amount of e-liquid (<0.15 mg), so that the ultrasonic atomization piece is started quickly and emits smoke quickly, the e-liquid is fully atomized, and the smoke generated can be maximized to meet user's demand for smoke. In addition, an n-shaped e-liquid guide groove is provided inside the e-liquid guide ceramic, and the top end of the e-liquid guide groove is communicated with an e-liquid cartridge, which makes e-liquid guide on both sides of the e-liquid guide ceramic uniform. Moreover, the bottom of the e-liquid guide groove is as close as possible to the bottom of both sides of the e-liquid guide ceramic, to shorten the travel distance of the e-liquid which flows to the ultrasonic atomization piece by penetrating through the e-liquid guide ceramic, thereby accelerating e-liquid supply and avoiding the phenomenon of dry burning caused by the slow supply of e-liquid when the ultrasonic atomization piece is working.

Preferably, a recovery groove is provided on the top surface of the air passage. When the ultrasonic atomization piece oscillates at a high frequency to atomize e-liquid, smoke is sprayed into the recovery groove. After large-particle e-liquid droplets in the smoke are absorbed by the recovery groove, the smoke is discharged through the smoke outlet, thereby preventing the user from inhaling e-liquid droplets and improving the user experience.

Preferably, the bottom surface of the e-liquid guide ceramic presses an e-liquid reservoir against the atomization region of the ultrasonic atomization piece, so that the e-liquid guided by the e-liquid guide ceramic to the ultrasonic atomization piece can be temporarily stored in the e-liquid reservoir, to avoid the phenomenon of dry burning caused by insufficient e-liquid supply of the e-liquid guide ceramic.

Preferably, the e-liquid guide ceramic is installed at a distance from the ultrasonic atomization piece, an n-shaped e-liquid guide groove is provided inside the e-liquid guide ceramic, and the top end of the e-liquid guide groove is communicated with an e-liquid cartridge; the bottom of the e-liquid guide groove penetrates the bottom of the e-liquid guide ceramic, so that the lower segment of the e-liquid guide groove also serves as an e-liquid reservoir fixing groove; two ends of the e-liquid reservoir are inserted and fixed in the e-liquid reservoir fixing groove, and the middle part of the e-liquid reservoir is pressed against the atomization region of the ultrasonic atomization piece by a spring.

The e-liquid guide ceramic is installed at a distance from the ultrasonic atomization piece, so that the e-liquid guide ceramic will not cover the atomization region of the ultrasonic atomization piece to affect the amount of atomization in the atomization region of the ultrasonic atomization piece, the ultrasonic atomization heat absorbed by the e-liquid guide ceramic is reduced correspondingly, and less heat is transferred by the e-liquid guide ceramic to the e-liquid in the e-liquid cartridge, which has a little impact on the physical and chemical properties of the e-liquid in the e-liquid cartridge, will not change the shelf life of the e-liquid, and also avoids peculiar smell of the smoke caused by the deterioration of e-liquid.

Preferably, the e-liquid reservoir is provided with fixed segments, transition segments and a contact segment from two ends to the middle, the fixed segments are inserted and fixed in the e-liquid reservoir fixing groove, and the contact segment is pressed against the atomization region of the ultrasonic atomization piece by a spring and arranged just below the e-liquid guide ceramic.

In this way, e-liquid can be transferred to the contact segment by the fixed segments of the e-liquid reservoir and finally arrive at the atomization region of the ultrasonic atomization piece, or can directly penetrate into the contact segment of the e-liquid reservoir through the e-liquid guide ceramic and finally arrive at the atomization region of the ultrasonic atomization piece. Moreover, when the fixed segments of the e-liquid reservoir fit the e-liquid reservoir fixing groove too tight to hinder the e-liquid and air from passing through the fixed segments, the e-liquid and the air can penetrate each other through the e-liquid guide ceramic to replace the e-liquid in the e-liquid cartridge with air, so that the e-liquid can be smoothly transferred to the ultrasonic atomization piece along the space between the e-liquid reservoir and the e-liquid guide ceramic and supplied for ultrasonic atomization to form smoke, to avoid the phenomenon of dry burning caused by insufficient supply of e-liquid. In addition, because the porosity of the e-liquid guide ceramic is constant, the penetration of the e-liquid and air in the e-liquid guide ceramic are uniform, which can prevent insufficient atomization caused by excessive e-liquid on the surface of the atomization region of the ultrasonic atomization piece and prevent inhaling of e-liquid droplets.

Specifically, the ultrasonic atomizer further includes a housing and a plug that are clamped and engaged with each other, and an e-liquid cartridge is arranged between the housing and the plug; an e-liquid passing groove, the e-liquid guide ceramic fixing groove, the atomization cavity, and an atomization core mounting groove are sequentially provided at the middle part of the plug from top to bottom; an air inlet groove communicated with the air inlet is provided on one side of the atomization core mounting groove, and an atomization core is mounted in the atomization core mounting groove. The atomization core (3) includes a conductive hollow atomization sleeve (31), and the ultrasonic atomization piece (32), an insulating seat (33) and a printed circuit board (PCB) (34) are sequentially arranged in the inner cavity of the atomization sleeve (31) from top to bottom.

In order to solve the above technical problem, the present invention further provides an electronic cigarette, including the above-mentioned ultrasonic atomizer.

Compared with the prior art, the present invention has the following beneficial effects:

1. The top surface of the atomization cavity and the surface of the atomization region of the ultrasonic atomization piece form an angle, so that the main air flow passing through the atomization cavity is also at an angle with the ultrasonic atomization piece, which reduces splashing e-liquid droplets taken away by the air flow, prevents the user from inhaling the e-liquid droplets, and improves the user experience.

2. The e-liquid guide ceramic is not in contact with the ultrasonic atomization piece, which neither affects the e-liquid atomization area of the ultrasonic atomization piece, nor affects the speed of e-liquid transfer, thereby increasing the atomization amount of e-liquid and making the smoke taste more mellow:

3. The e-liquid guide ceramic is not in contact with the ultrasonic atomization piece, which can prevent the energy released by e-liquid atomization of the ultrasonic atomization piece from being absorbed by the e-liquid guide ceramic, and prevent the above energy from transferring to the e-liquid from the e-liquid guide ceramic to affect the shelf life of the e-liquid and to cause the peculiar smell of the smoke:

4. The top surface and the bottom surface of the atomization cavity form an angle, so that the air flow passing through the atomization cavity is also at an angle with the ultrasonic atomization piece, which reduces splashing e-liquid droplets taken away by the air flow, prevents the user from inhaling the e-liquid droplets, and improves the user experience.

1—main body; 11—housing; 12—plug; 13—e-liquid cartridge; 111—suction nozzle; 112—air outlet tube; 121—e-liquid passing groove; 122—e-liquid guide ceramic fixing groove; 123—atomization cavity; 124—atomization cavity mounting groove; 125—air inlet groove; 126 air tube insertion hole; 1231—first inclined surface; 1232—air inlet; 1233—smoke outlet;

2—e-liquid guide assembly; 21—e-liquid guide ceramic; 22, e-liquid reservoir; 23—spring; 211—air passage; 212—e-liquid guide groove; 213—recovery groove; 214—second inclined surface; 215—e-liquid reservoir fixing groove; 221—fixed segment; 222—transition segment; 223—contact segment;

3—atomization core; 31—atomization sleeve; 32—ultrasonic atomization piece; 33—insulating seat; 34—PCB; 35—electrode assembly; 321—atomization region.

DETAILED DESCRIPTION OF THE EMBODIMENTS

The present invention will be further described below with reference to specific preferred embodiments, but the scope of protection of the present invention is not limited thereby.

For ease of description, the relative positional relationships of components, such as upper, lower, left, and right, are described according to the layout direction of the accompanying drawings in the specification, and do not limit the structure of this patent.

Embodiment 1

Figure 1:
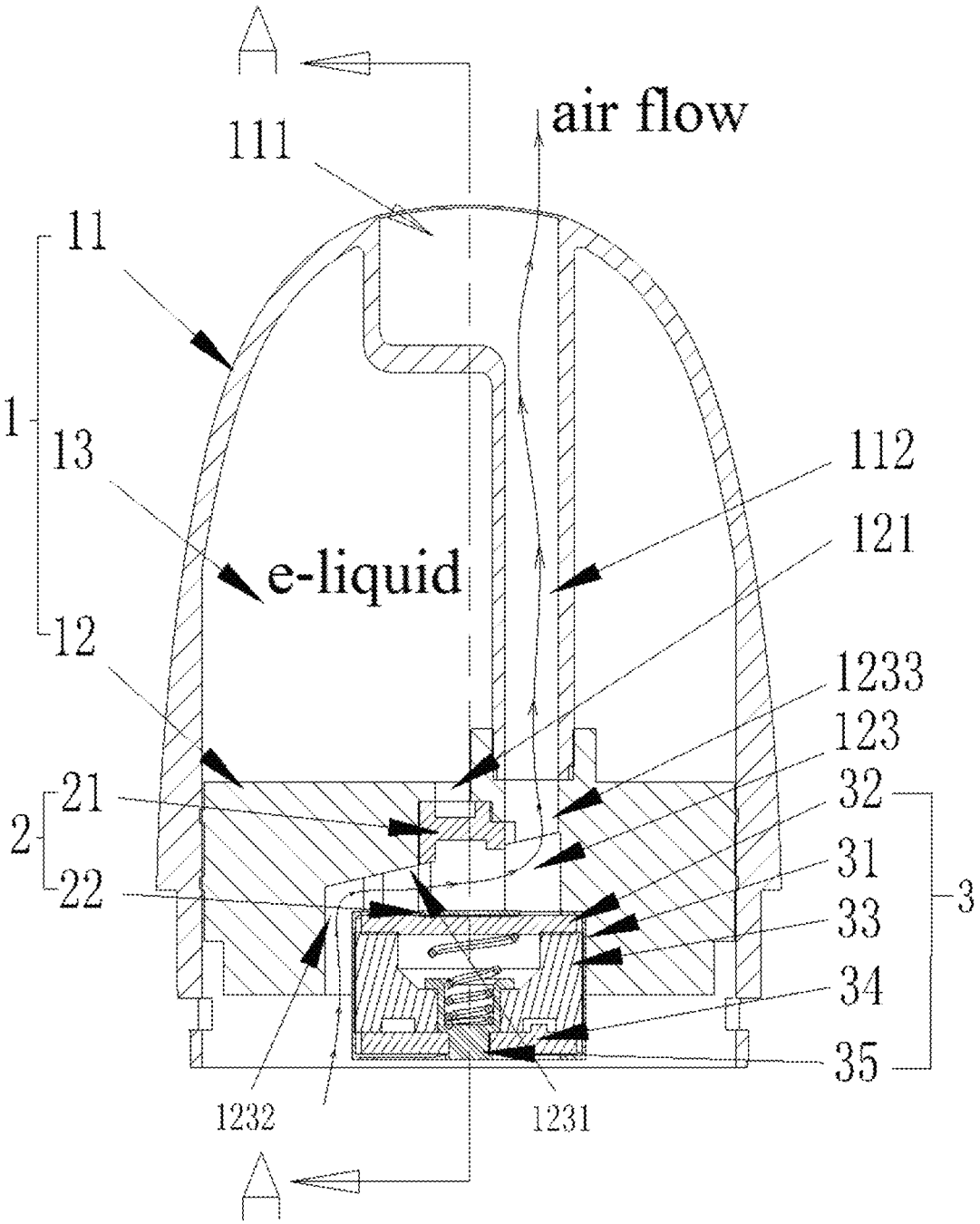
FIG. 1 is a front sectional view of a first embodiment of an ultrasonic atomizer of the present invention, in which arrows indicate the flow direction of air.
Figure 2:
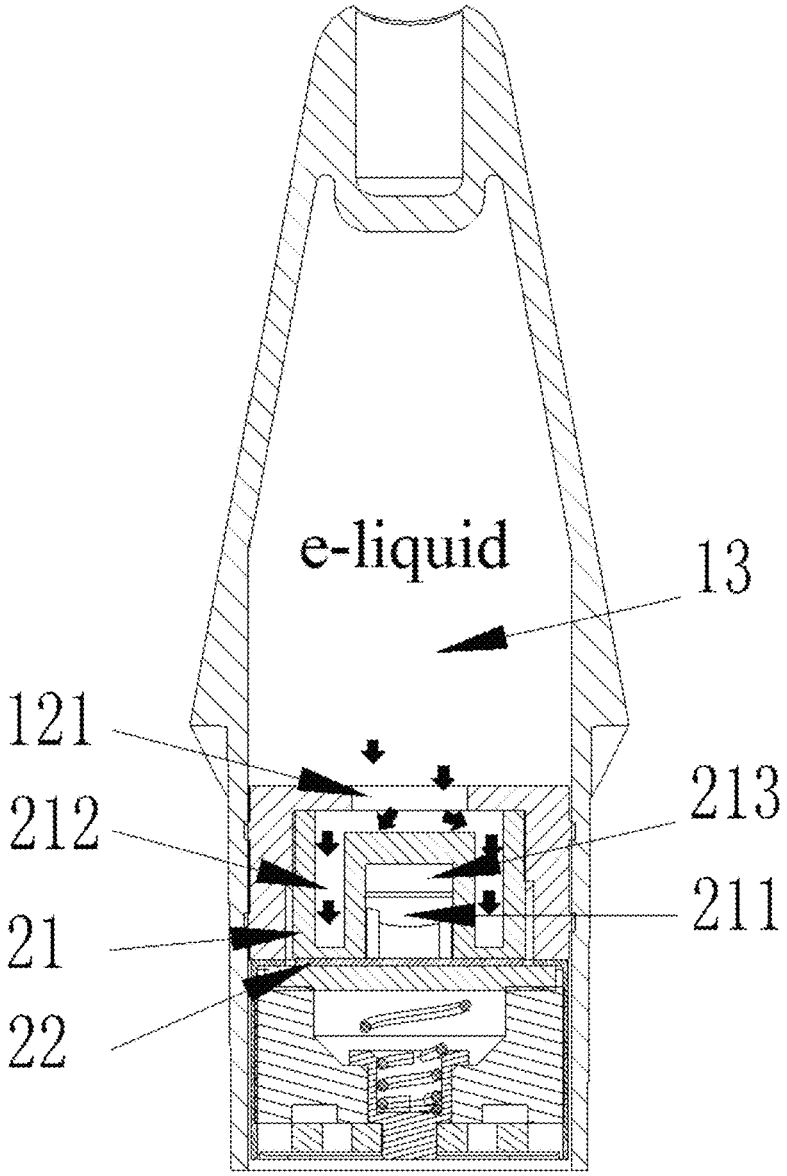
FIG. 2 is a cross-sectional view taken along line A-A of FIG. 1, in which arrows indicate the flow direction of e-liquid.
Figure 3:
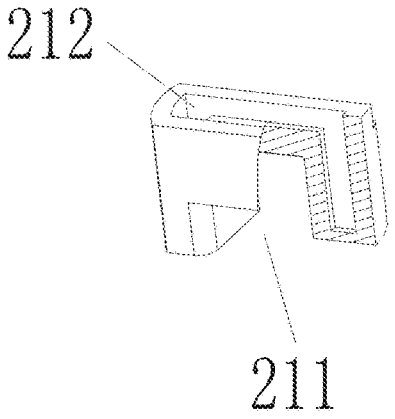
FIG. 3 is a partial front sectional view of an e-liquid guide ceramic according to the first embodiment of the present invention.
Figure 4:
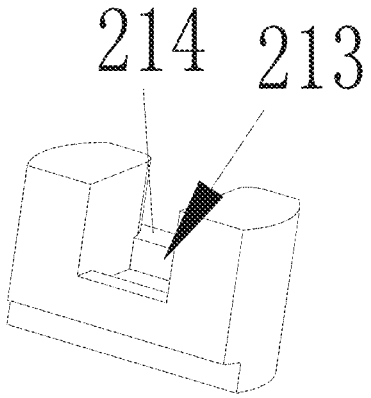
FIG. 4 is a three-dimensional structural diagram of the e-liquid guide ceramic seen from the bottom according to the first embodiment of the present invention.
Figure 5:
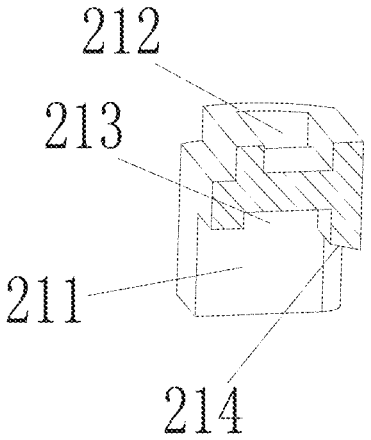
FIG. 5 is a sectional view of the e-liquid guide ceramic seen from the bottom according to the first embodiment of the present invention.
Figure 6:
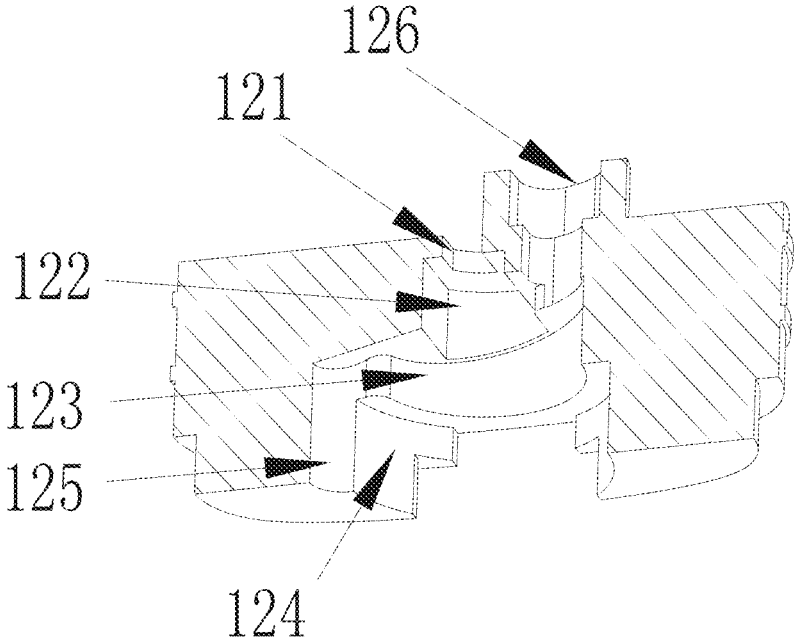
FIG. 6 is a three-dimensional structural diagram of a plug in an upright state according to the first embodiment of the present invention.
Figure 7:
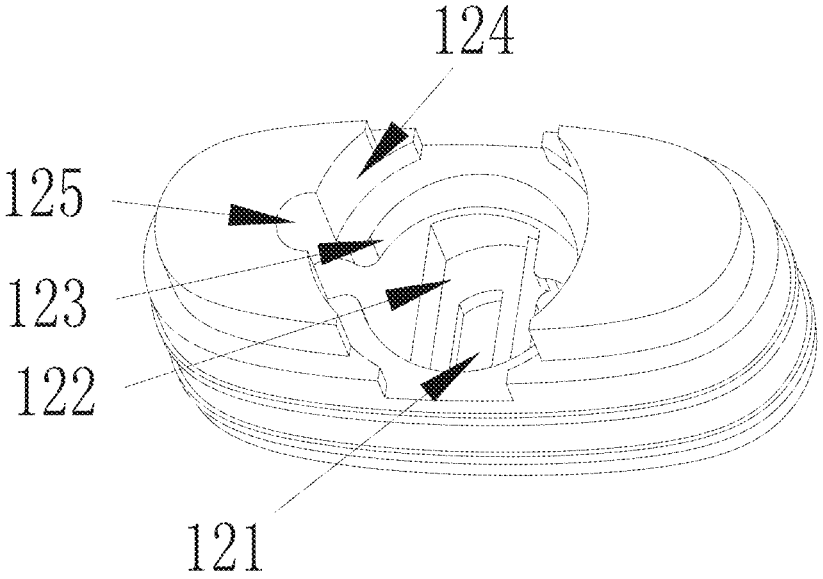
FIG. 7 is a three-dimensional structural diagram of the plug in an inverted state according to the first embodiment of the present invention.
Figure 8:
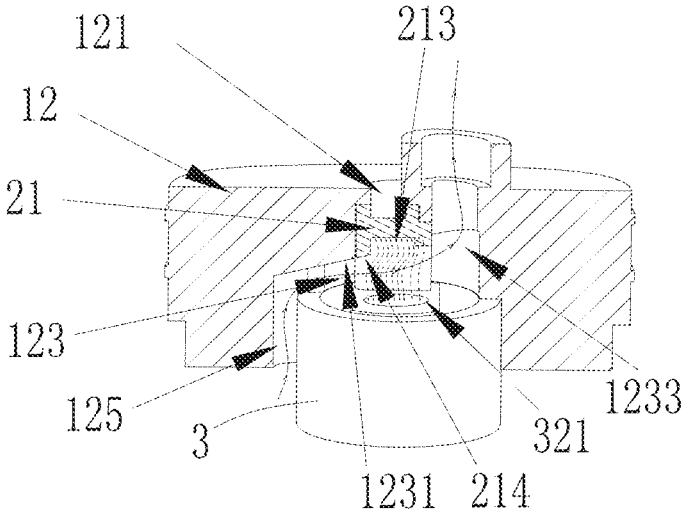
FIG. 8 is a structural diagram of the plug and an atomization core according to the first embodiment of the present invention, in which arrows indicate the flow direction of air, and dotted lines indicate smoke.
Figure 9:
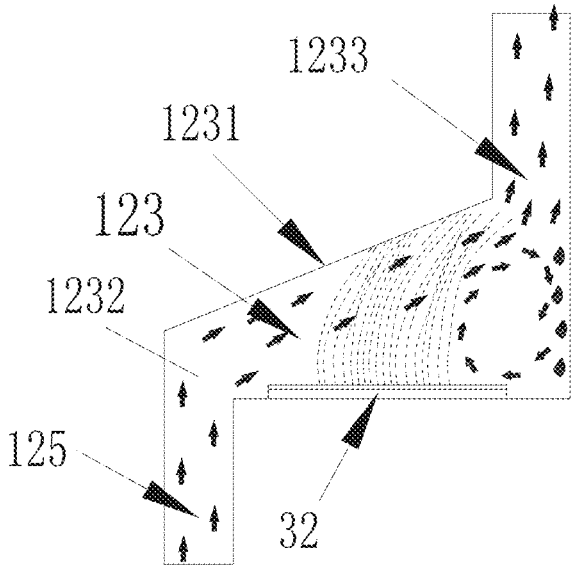
FIG. 9 is a schematic diagram of air flow and smoke flow in the atomization cavity according to the first embodiment of the present invention.
Figure 10:
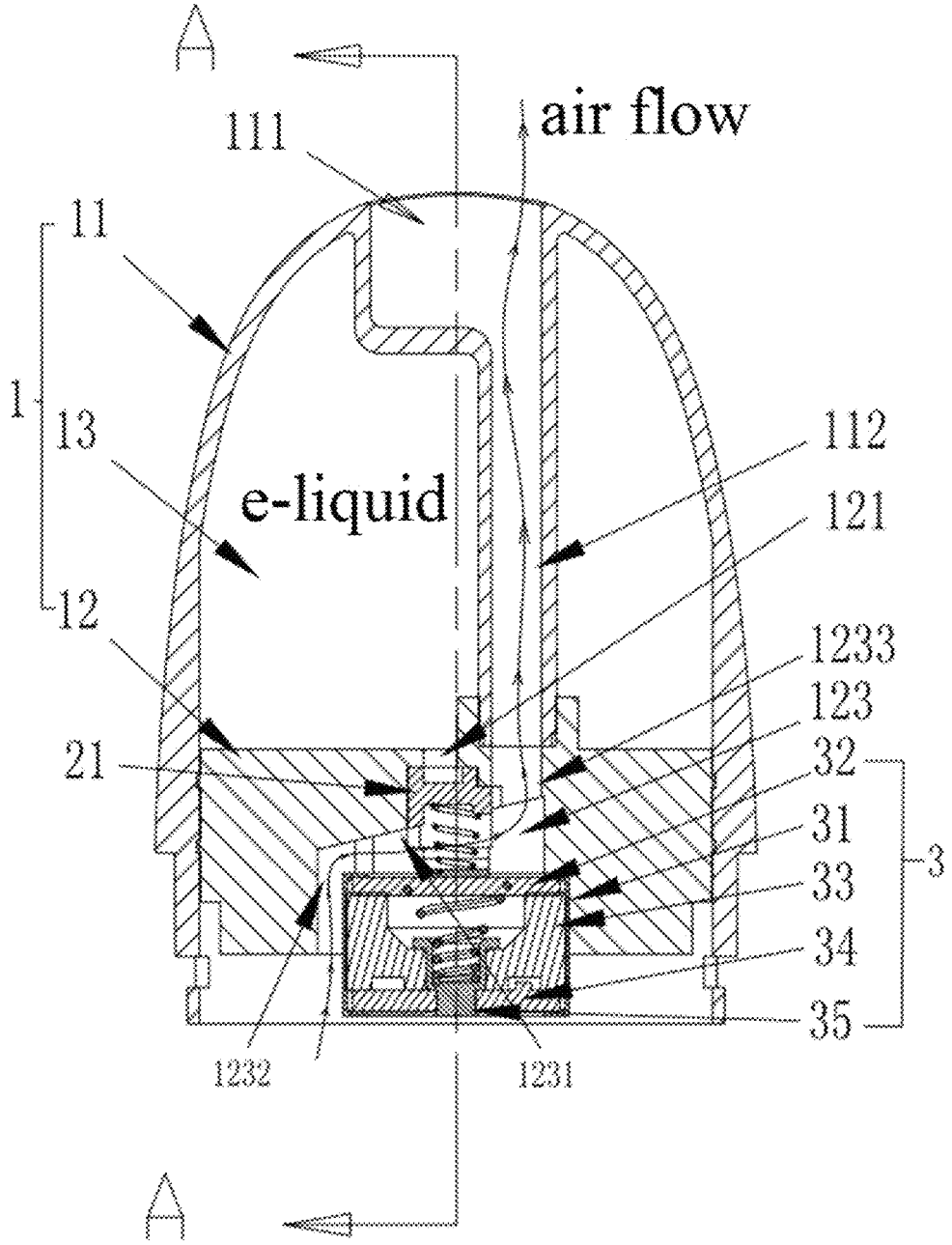
FIG. 10 is a front sectional view of a second embodiment of an ultrasonic atomizer of the present invention, in which arrows indicate the flow direction of air.
Figure 11:
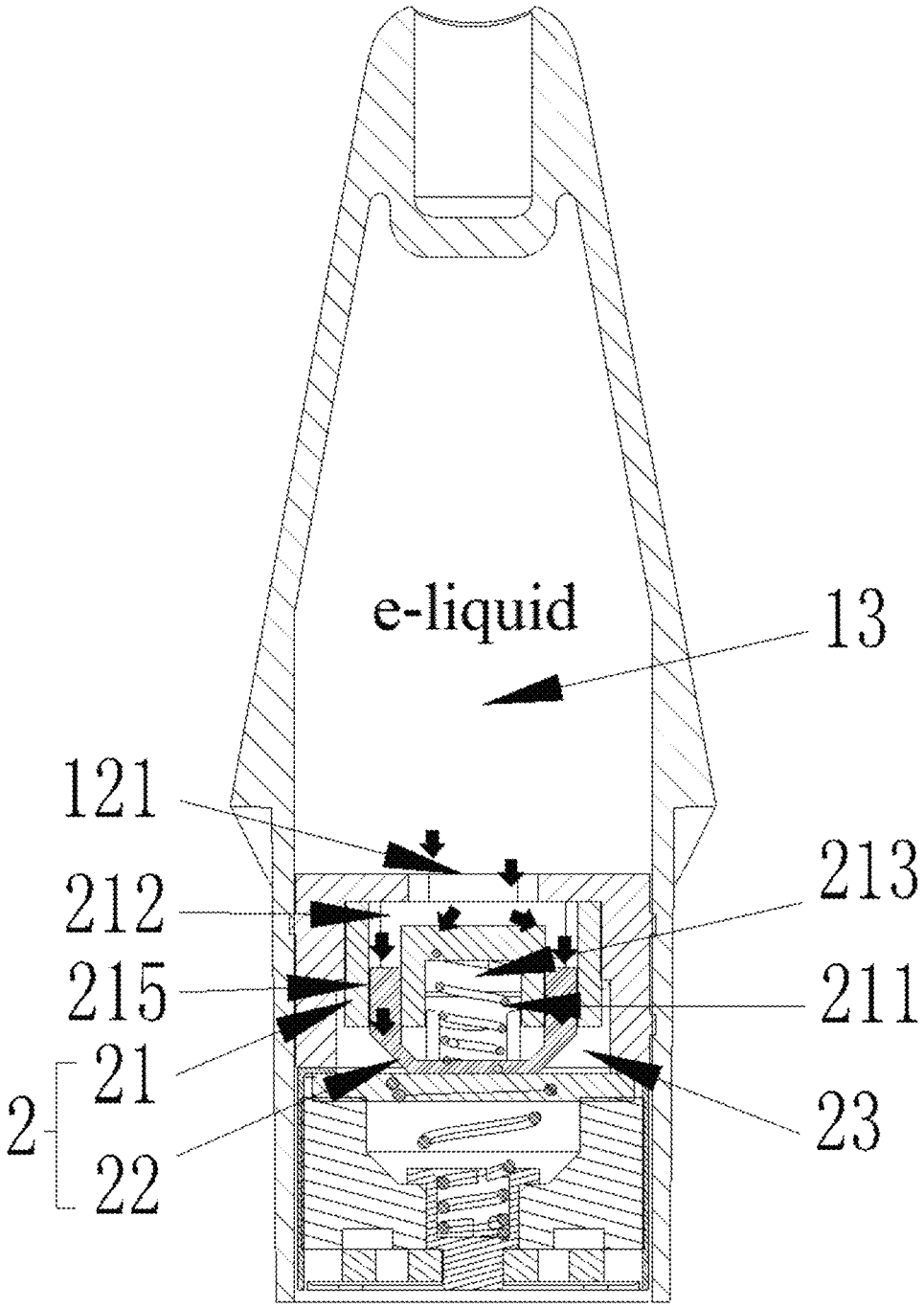
FIG. 11 is a cross-sectional view taken along line A-A of FIG. 10, in which arrows indicate the flow direction of e-liquid.
Figure 12:
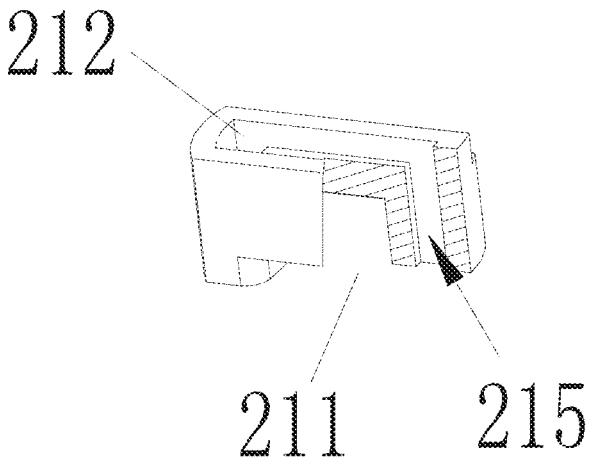
FIG. 12 is a partial front sectional view of an e-liquid guide ceramic according to the second embodiment of the present invention.
Figure 13:
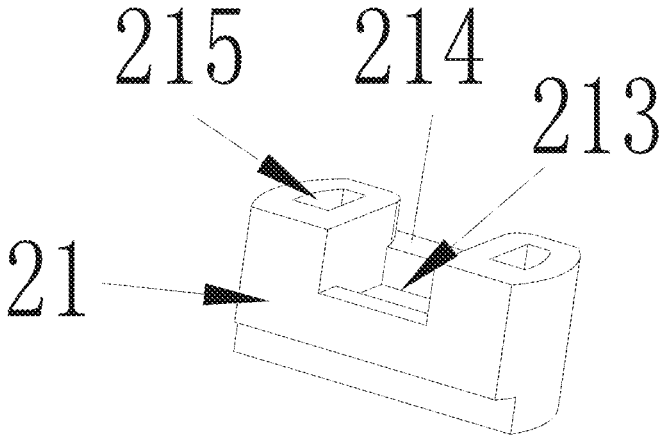
FIG. 13 is a three-dimensional view of the e-liquid guide ceramic seen from the bottom according to the second embodiment of the present invention.
Figure 14:
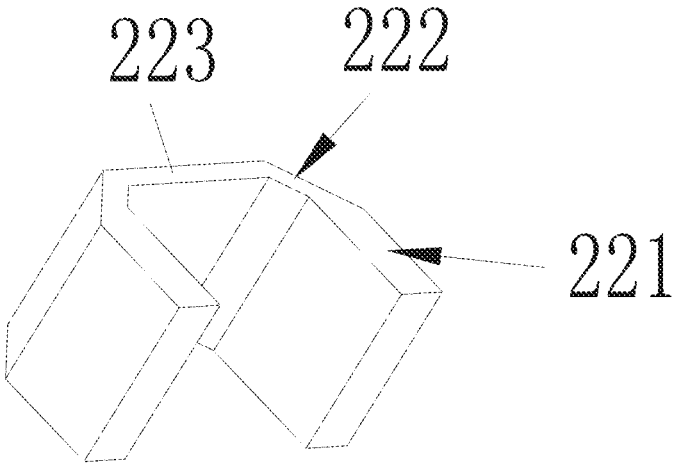
FIG. 14 is a three-dimensional structural diagram of an e-liquid reservoir according to the second embodiment of the present invention.
Figure 15:
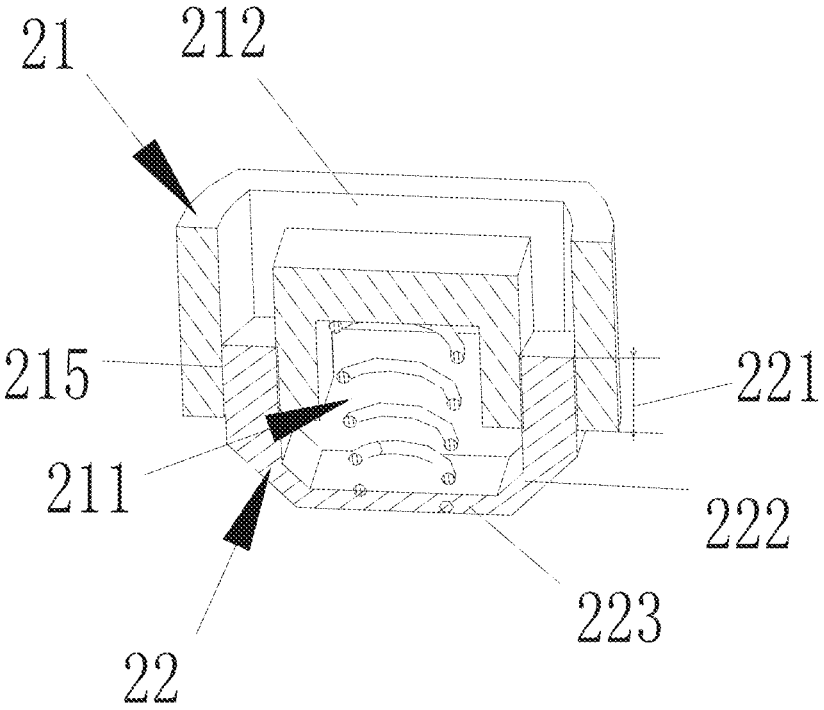
FIG. 15 is a cross-sectional three-dimensional structural diagram of the e-liquid guide ceramic and the e-liquid reservoir in a fitting state according to the second embodiment of the present invention.

As shown in FIGS. 1 to 9, an ultrasonic atomizer in this embodiment includes a main body 1, an e-liquid guide assembly 2 and an atomization core 3.

The main body 1 includes a housing 11 and a plug 12, and an e-liquid cartridge 13 is formed by connecting the housing 11 with the plug 12. The housing 11 is provided with a suction nozzle 111 and an air outlet tube 112. The plug 12 is preferably an elastic silica gel plug. An e-liquid passing groove 121, an e-liquid guide ceramic fixing groove 122, an atomization cavity 123, and an atomization core mounting groove 124 are sequentially provided at the middle part of the plug 12 from top to bottom; an air inlet groove 125 is provided on one side of the atomization core mounting groove 124, an air tube insertion hole 126 is provided at the top of the plug 12, and the air tube insertion hole 126 is connected with the bottom end of the air outlet tube 112 on the housing 11 to form an air outlet channel.

The e-liquid guide assembly 2 includes an e-liquid guide ceramic 21 installed in the e-liquid guide ceramic fixing groove 122 and an e-liquid reservoir 22 located on the bottom surface of the e-liquid guide ceramic 21.

The atomization core 3 includes a conductive hollow atomization sleeve 31, and an ultrasonic atomization piece 32, an insulating seat 33, and a PCB 34 are sequentially arranged in the inner cavity of the atomization sleeve 31 from top to bottom. An electrode assembly 35 is arranged in the middle of the insulating base 33 and the PCB 34. An upper surface electrode and an atomization region are arranged on the upper surface of the ultrasonic atomization piece 32, and a lower surface electrode is arranged on the lower surface of the ultrasonic atomization piece 32. The upper end of the atomization sleeve 31 is connected with the upper surface electrode of the ultrasonic atomization piece 32 in an abutting manner, the lower end of the atomization sleeve 31 is covered on the bottom surface of the PCB 34 to serve as a first electrode connecting terminal, the lower surface electrode of the ultrasonic atomization piece 32 is electrically connected with the electrode assembly 35, and the electrode assembly 35 serves as a second electrode terminal.

The atomization core 3 is mounted in the atomization core mounting groove 124, the atomization cavity 123 is arranged above the atomization core 3, the ultrasonic atomization piece 32 serves as the bottom surface of the atomization cavity 123 (the top end of the atomization sleeve 31 has an opening for exposing the atomization region of the atomization piece 32), and the atomization cavity 123 is formed in the plug 12.

The top surface of the atomization cavity 123 is configured as a first inclined surface 1231, an angle of 20°-75° is formed between the first inclined surface 1231 and the upper surface of the ultrasonic atomization piece 32, the bottom end of the first inclined surface 1231 is provided with an air inlet 1232 communicated with the air inlet groove 125, the top end of the first inclined surface 1231 is provided with a smoke outlet 1233 communicated with the air outlet tube 112, and the air inlet 1232 and the smoke outlet 1233 are arranged on two opposite sides of the atomization cavity 123. The opening size of the air inlet 1232 is increased gradually along the first inclined surface 1231 (in the presence of the first inclined surface 1231, the opening size of the air inlet 1232 gradually increases), the bottom surface of the smoke outlet 1233 is higher than the top surface of the air inlet 1232, and the bottom surface of the smoke outlet 1233 and the top surface of the air inlet 1232 are both located approximately in the plane where the first inclined surface 1231 is located, so that an inclined upward airflow channel from the air inlet 1232 to the smoke outlet 1233 is formed above the ultrasonic atomization piece.

The bottom surface of the e-liquid guide ceramic 21 presses the e-liquid reservoir 22 against the atomization region 321 of the ultrasonic atomization piece 32, and the center of the atomization region of the ultrasonic atomization piece 32 is just below the e-liquid guide ceramic 21.

In order to prevent the position, where the most violent ultrasonic oscillation occur, of the ultrasonic atomization piece 32 (the center of the atomization region) from being covered by the e-liquid guide ceramic 21, and to ensure that the airflow channel in the atomization cavity 123 is unobstructed, the e-liquid guide ceramic 21 is n-shaped as a whole, and an air passage 211 is provided in the middle of the bottom of the e-liquid guide ceramic 21. The air passage 211 is arranged corresponding to the center of the atomization region of the ultrasonic atomization piece 32, to prevent the e-liquid guide ceramic 21 from affecting the high-frequency oscillating atomization effect at the center of the ultrasonic atomization piece 32, so that the ultrasonic atomization piece 32 is started quickly for ultrasonic atomization and emits smoke quickly, the generated smoke is maximized as soon as possible, and the e-liquid is fully atomized to prevent the user from inhaling e-liquid droplets.

In order to prevent the top surface of the air passage 211 of the e-liquid guide ceramic 21 from affecting the trend of inclined upward flow of air, the top surface of the air passage 211 is configured as a second inclined surface 214, and the first inclined surface 1231 and the second inclined surface 214 are located on the same inclined surface.

In order to enable the e-liquid guide ceramic 21 to transfer e-liquid as soon as possible so as to ensure e-liquid supply for ultrasonic atomization, an n-shaped e-liquid guide groove 212 is provided inside the e-liquid guide ceramic 21, the upper part of the e-liquid guide groove 212 is aligned with the e-liquid passing groove 121, and the bottom of the e-liquid guide groove 212 extends to the bottom of the e-liquid guide ceramic 21; the top end of the e-liquid guide groove 212 is communicated with the e-liquid cartridge 13, the lower end of the e-liquid guide groove 212 is a blind hole (which is beneficial to preventing a large amount of e-liquid from entering the e-liquid reservoir 22), and the e-liquid in the e-liquid cartridge 13 enters the e-liquid guide groove 212 through the e-liquid passing groove 121 and then penetrates into the e-liquid reservoir 22.

In order to recycle splashing e-liquid droplets produced during the oscillation of the ultrasonic atomization piece 32 and large-particle e-liquid droplets in the smoke, the top surface of the air passage 211 is provided with a recovery groove 213 for recovering the e-liquid, and the recovery groove 213 is arranged corresponding to the center of the atomization region of the ultrasonic atomization piece 32.

In order to avoid the phenomenon of air trapping, the outlet end of the air passage 211 is directly communicated with the smoke outlet 1233, so that the smoke inside the air passage 211 can be directly discharged through the smoke outlet 1233.

In order to allow the e-liquid to quickly arrive at the place around the e-liquid guide ceramic 21 after penetrating through the e-liquid guide ceramic 21, the middle part of the e-liquid guide groove 212 is arranged corresponding to the recovery groove 213, and the middle part of the e-liquid guide groove 212 and the recovery groove 213 are both arranged at the middle part of the e-liquid guide ceramic 21.

When the ultrasonic atomizer in this embodiment is used, the user inhales from the suction nozzle 111 of the main body 1, outside air enters the atomization cavity 123 from the air inlet groove 125, e-liquid is transferred by the e-liquid guide assembly 2 from the e-liquid cartridge 13 to the ultrasonic atomization piece 32, the ultrasonic atomization piece 32 is electrically connected to an external power supply by means of the atomization sleeve 31 and the electrode assembly 35 to implement ultrasonic atomization, and most of the intake air is guided by the top surface (the first inclined surface) of the atomization cavity 123 and flows obliquely upward to the smoke outlet. During this process, most of the intake air passes through the end of smoke, that is, the smoke far from the surface of the atomization region of the ultrasonic atomization piece is brought to the smoke outlet, and is discharged by the air outlet tube and the suction nozzle. A small part of the intake air passes through the beginning of smoke, that is, the surface of the atomization region, so that the smoke containing large-particle e-liquid droplets near the surface of the atomization region hits the inner wall of the atomization cavity near the smoke outlet and condenses, while a small part of the air returns to the ultrasonic atomization piece along the inner wall of the atomization cavity, and the e-liquid droplets contained in the smoke participate in the ultrasonic atomization again.

Embodiment 2

Embodiment 2 differs from Embodiment 1 in the e-liquid guide assembly 2. The e-liquid guide assembly 2 in Embodiment 2 includes an e-liquid guide ceramic 21 installed in the e-liquid guide ceramic fixing groove 122, an e-liquid reservoir 22 fixedly installed at the lower part of the e-liquid guide ceramic 21, and a spring 23 arranged between the e-liquid guide ceramic 22 and the e-liquid reservoir 22. In order to prevent the e-liquid guide ceramic 21 from covering the atomization region 321 of the ultrasonic atomization piece 32 to affect the amount of atomization, and to ensure that the airflow channel in the atomization cavity 123 is unobstructed, the bottom surface of the e-liquid guide ceramic 21 is spaced apart from the atomization region 321 of the ultrasonic atomization piece 32 by a distance. The e-liquid guide ceramic 21 is n-shaped as a whole, and an n-shaped e-liquid guide groove 212 is provided inside the e-liquid guide ceramic 21. The bottom of the e-liquid guide groove 212 penetrates the bottom of the e-liquid guide ceramic 21, so that the lower segment of the e-liquid guide groove 212 also serves as an e-liquid reservoir fixing groove 215. The e-liquid reservoir 22 is made of a flexible material, such as a cotton material, and the e-liquid reservoir 22 includes fixed segments 221, transition segments 222 and a contact segment 223. The fixed segments 221 are located at two ends of the e-liquid reservoir 22, the contact segment 223 is located in the middle of the e-liquid reservoir 22, the transition segments 222 are used to connect the fixed segments 221 with the contact segment 223, the fixed segments 221 are inserted and fixed in the e-liquid reservoir fixing groove 215, and the contact segment 223 is pressed against the atomization region 321 of the ultrasonic atomization piece 32 of the atomization core 3 by the spring 23, and is just below the e-liquid guide ceramic 21. The upper end of the spring 23 abuts against the e-liquid guide ceramic 21, and the lower end of the spring 23 abuts against the contact segment 223.

The e-liquid from the e-liquid cartridge 14 can be transferred by the fixed segments 221 of the e-liquid reservoir 22 to the contact segment 223 and finally arrive at the atomization region 321 of the ultrasonic atomization piece 32, or can be transferred by the e-liquid guide ceramic 21 to the contact segment 223 of the e-liquid reservoir 22 and finally arrive at the atomization region 321 of the ultrasonic atomization piece 32. When the fixed segments 221 of the e-liquid reservoir 22 fit the e-liquid reservoir fixing groove 215 too tight to hinder the e-liquid and air from passing through the fixed segments 221, the e-liquid and the air can penetrate each other through the e-liquid guide ceramic 21 to replace the e-liquid in the e-liquid cartridge 13 with air, so that the e-liquid can be smoothly transferred to the ultrasonic atomization piece 32 along the space between the e-liquid reservoir 22 and the e-liquid guide ceramic 21 and supplied for ultrasonic atomization to form smoke, to avoid the phenomenon of dry burning caused by insufficient supply of e-liquid. In addition, because the porosity of the e-liquid guide ceramic 21 is constant, the penetration of the e-liquid and air in the e-liquid guide ceramic 21 are uniform, which can prevent insufficient atomization caused by excessive e-liquid on the surface of the atomization region of the ultrasonic atomization piece 32 and prevent inhaling of e-liquid droplets.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The invention claimed is:

1. An ultrasonic atomizer, comprising a plug, wherein an atomization cavity with an air inlet and a smoke outlet is formed in a middle part of the plug, an ultrasonic atomization piece is installed at a bottom of the atomization cavity, a top surface of the atomization cavity faces an atomization region of the ultrasonic atomization piece and is inclined at an angle of 20°-75° relative to the ultrasonic atomization piece, thus comprising a first inclined surface comprising a single element including the top surface of the atomization cavity, the air inlet is arranged at a bottom end of the first inclined surface, the smoke outlet is arranged at a top end of the first inclined surface, the air inlet and the smoke outlet are arranged on two opposite sides of a center of the atomization region of the ultrasonic atomization piece respectively, and a bottom surface of the smoke outlet is higher than a top surface of the air inlet, and the first inclined surface, the bottom surface of the smoke outlet, and the top surface of the air inlet are located approximately in a single plane, so that a single inclined upward airflow channel is formed inside the atomization cavity above the ultrasonic atomization piece and inclined upwardly along the first inclined surface from the air inlet to the smoke outlet such that intake air flows along the first inclined surface to the smoke outlet.

2. The ultrasonic atomizer according to claim 1, wherein an e-liquid guide ceramic is placed above the atomization region of the ultrasonic atomization piece, an air passage is provided in a middle part of the e-liquid guide ceramic, and the air passage is arranged corresponding to the center of the atomization region of the ultrasonic atomization piece.

3. The ultrasonic atomizer according to claim 2, wherein a top surface of the air passage is configured as a second inclined surface, and the first inclined surface and the second inclined surface are located on the same inclined surface.

4. The ultrasonic atomizer according to claim 2, wherein the e-liquid guide ceramic is n-shaped as a whole, an n-shaped e-liquid guide groove is provided inside the e-liquid guide ceramic, and a top end of the e-liquid guide groove is communicated with an e-liquid cartridge.

5. The ultrasonic atomizer according to claim 2, wherein a recovery groove for recovering e-liquid is provided on a top surface of the air passage.

6. The ultrasonic atomizer according to claim 4, wherein a bottom surface of the e-liquid guide ceramic presses an e-liquid reservoir against the atomization region of the ultrasonic atomization piece.

7. The ultrasonic atomizer according to claim 2, wherein the e-liquid guide ceramic is installed at a distance from the ultrasonic atomization piece, an n-shaped e-liquid guide groove is provided inside the e-liquid guide ceramic, and a top end of the e-liquid guide groove is communicated with an e-liquid cartridge; a bottom of the e-liquid guide groove penetrates the bottom of the e-liquid guide ceramic, so that a lower segment of the e-liquid guide groove also serves as an e-liquid reservoir fixing groove; two ends of an e-liquid reservoir are inserted and fixed in the e-liquid reservoir fixing groove, and a middle part of the e-liquid reservoir is pressed against the atomization region of the ultrasonic atomization piece by a spring.

8. The ultrasonic atomizer according to claim 7, wherein the e-liquid reservoir is provided with fixed segments, transition segments, and a contact segment from two ends of the e-liquid reservoir to the middle of the e-liquid reservoir, the fixed segments are inserted and fixed in the e-liquid reservoir fixing groove, and the contact segment is pressed against the atomization region of the ultrasonic atomization piece by the spring and arranged just below the e-liquid guide ceramic.

9. The ultrasonic atomizer according to claim 1, further comprising a housing, wherein the housing and the plug which are clamped and engaged with each other, an e-liquid cartridge is arranged between the housing and the plug; an e-liquid passing groove, an e-liquid guide ceramic fixing groove, the atomization cavity, and an atomization core mounting groove are sequentially provided at the middle part of the plug from top to bottom; an air inlet groove communicated with the air inlet is provided on one side of the atomization core mounting groove, and an atomization core is mounted in the atomization core mounting groove.

10. The ultrasonic atomizer according to claim 9, wherein the atomization core comprises a conductive hollow atomization sleeve, and the ultrasonic atomization piece, an insulating seat, and a PCB are sequentially arranged in the inner cavity of the atomization sleeve from top to bottom.

11. The ultrasonic atomizer according to claim 1, wherein the opening size of the air inlet gradually increases.

12. An electronic cigarette comprising the ultrasonic atomizer according to claim 1.

13. The electronic cigarette according to claim 12, wherein an e-liquid guide ceramic is placed above the atomization region of the ultrasonic atomization piece, an air passage is provided in a middle part of the e-liquid guide ceramic, and the air passage is arranged corresponding to the center of the atomization region of the ultrasonic atomization piece.

14. The electronic cigarette according to claim 13, wherein a top surface of the air passage is configured as a second inclined surface, and the first inclined surface and the second inclined surface are located on the same inclined surface.

15. The electronic cigarette according to claim 13, wherein the e-liquid guide ceramic is n-shaped as a whole, an n-shaped e-liquid guide groove is provided inside the e-liquid guide ceramic, and a top end of the e-liquid guide groove is communicated with an e-liquid cartridge.

16. The electronic cigarette according to claim 13, wherein a recovery groove for recovering e-liquid is provided on a top surface of the air passage.

17. The electronic cigarette according to claim 15, wherein a bottom surface of the e-liquid guide ceramic presses an e-liquid reservoir against the atomization region of the ultrasonic atomization piece.

18. The electronic cigarette according to claim 13, wherein the e-liquid guide ceramic is installed at a distance from the ultrasonic atomization piece, an n-shaped e-liquid guide groove is provided inside the e-liquid guide ceramic, and a top end of the e-liquid guide groove is communicated with an e-liquid cartridge; a bottom of the e-liquid guide groove penetrates the bottom of the e-liquid guide ceramic, so that a lower segment of the e-liquid guide groove also serves as an e-liquid reservoir fixing groove, two ends of an e-liquid reservoir are inserted and fixed in the e-liquid reservoir fixing groove, and a middle part of the e-liquid reservoir is pressed against the atomization region of the ultrasonic atomization piece by a spring.

19. The electronic cigarette according to claim 18, wherein the e-liquid reservoir is provided with fixed segments, transition segments, and a contact segment from two ends of the e-liquid reservoir to the middle of the e-liquid reservoir, the fixed segments are inserted and fixed in the e-liquid reservoir fixing groove, and the contact segment is pressed against the atomization region of the ultrasonic atomization piece by the spring and arranged just below the e-liquid guide ceramic.

20. The electronic cigarette according to claim 12, wherein the opening size of the air inlet gradually increases.

* * * * *